US008303318B2

(12) United States Patent
Malek

(10) Patent No.: US 8,303,318 B2
(45) Date of Patent: Nov. 6, 2012

(54) VARIABLE GROUNDING PLUG DESIGN FOR CONTINENTAL EUROPE

(75) Inventor: Alisyn M. Malek, Detroit, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 234 days.

(21) Appl. No.: 12/786,889

(22) Filed: May 25, 2010

(65) Prior Publication Data

US 2011/0294318 A1 Dec. 1, 2011

(51) Int. Cl.
*H01R 4/66* (2006.01)

(52) U.S. Cl. ..... 439/101

(58) Field of Classification Search ..... 439/101, 439/103, 502, 172
See application file for complete search history.

(56) References Cited

U.S. PATENT DOCUMENTS 3,533,388 A * 10/1970 Moss ..... 123/146.5 A
3,733,576 A * 5/1973 Cooper ..... 439/103
3,786,392 A 1/1974 McDaniel
3,825,875 A 7/1974 Garrett
4,081,206 A * 3/1978 Lee ..... 439/104
4,326,763 A 4/1982 Ristovski
5,159,545 A 10/1992 Lee
6,971,920 B2 12/2005 Crupi
7,220,139 B1 5/2007 Chang et al.
7,354,286 B1 * 4/2008 Lee ..... 439/172
2002/0154528 A1 * 10/2002 Ravid ..... 363/146
2005/0250375 A1 * 11/2005 Allison ..... 439/502
2011/0175569 A1 * 7/2011 Austin ..... 320/109

* cited by examiner

*Primary Examiner* — Jean F Duverne
(74) *Attorney, Agent, or Firm* — Cantor Colburn LLP

(57) ABSTRACT

An electrical plug for charging a vehicle is provided. The electrical plug has variable grounding and includes a plug body and a collar configured to selectively adjust between a first and second position along the plug body to selectively expose a face portion of the electrical plug. The electrical plug further includes a first electrical prong and a second electrical prong extending from the face portion, the first and second electrical prong enable current transmission. The electrical plug further includes a plurality of grounding mechanisms compatible with a plurality of receptacles respectively, each of the plurality of grounding mechanisms provide a connection to ground.

19 Claims, 2 Drawing Sheets

VARIABLE GROUNDING PLUG DESIGN FOR CONTINENTAL EUROPE

FIELD OF THE INVENTION

Exemplary embodiments of the present invention are related to charging systems and, more specifically, to a charging system having an electrical plug with variable grounding.

BACKGROUND

Continental Europe shares a standardized two prong live plug design, however there are 5 different mechanisms used for grounding these plugs for high powered electrical devices. As most high power electrical devices, such as refrigerators and stoves, are often stationary, no need for a plug which satisfies the grounding design for more than two of these receptacle types has existed. For most small appliances, which require no grounding, a simple Europlug is used. This plug is standard across continental Europe. For grounded adapters, currently most often an interface is used which has a female face that accepts the plug type of the appliance, and a male face which has the correct design to insert into the desired receptacle. Another method is used with simple Europlug designs, in which a case is closed around the plug. Inside of this case are connectors which connect to the two live lines of the Europlug. These lines connect to prongs on the outside of the case, which are of the desired plug type, thus adapting the plug to the desired receptacle. These methods of adaption are suitable for infrequent, predetermined travel, so that one can be sure to have the correct plug type. However, plug-in hybrid electric vehicles (PHEVs) and electric vehicles (EVs) will change this standard of travel infrequency and in the future, other electronics requiring grounding.

With the entrance of PHEVs and EVs into the commercial automotive market, the first high powered electrical devices requiring grounding while engaged with the grid were created. These vehicles have the ability to cross the borders of plug standards with high frequency and ease. High volume projection of PHEV and EV penetration is leading to a new requirement in AC plug design. In order to minimize the number of parts and products that must be offered to accompany a vehicle or current or later developed portable grounded electronics, a new design is necessary.

Accordingly, it is desirable to provide a charging system with an electrical plug or adapter having variable grounding that meets the requirements of all continental European plug design standards in a single plug design.

SUMMARY

In one exemplary embodiment of the present invention, an electrical plug is provided. The electrical plug includes a plug body; a collar configured to selectively adjust between a first and second position along the plug body to selectively expose a face portion of the electrical plug; a first electrical prong and a second electrical prong extending from the face portion, the first and second electrical prongs configured to enable current transmission; and a plurality of grounding mechanisms compatible with a plurality of receptacles respectively, each of the plurality of grounding mechanisms configured to provide a connection to ground.

In another exemplary embodiment of the present invention, an electrical vehicle plug for charging a vehicle is provided. The electrical vehicle plug includes plug body; a collar configured to selectively adjust between a first and second position along the plug body to selectively expose a face portion of the electrical vehicle plug; a first electrical prong and a second electrical prong extending from the face portion, the first and second electrical prongs configured to enable current transmission to and from the vehicle; and a plurality of grounding mechanisms compatible with a plurality of receptacles respectively, each of the plurality of grounding mechanisms provide a connection to ground.

In yet another exemplary embodiment of the present invention, a vehicle charging cord for charging a vehicle is provided. The vehicle charging cord includes a vehicle plug having: a plug body; a collar configured to selectively adjust between a first and second position along the plug body to selectively expose a face portion of the vehicle plug; a first electrical prong and a second electrical prong extending from the face portion, the first and second electrical prong configured to transmit current transmission to and from the vehicle; a plurality of grounding mechanisms compatible with a plurality of receptacles respectively, each of the plurality of grounding mechanisms provide a connection to ground; and a controller configured to verify connection to ground and enable the first and second electrical prongs to receive and deliver current from at least one of the plurality of receptacles The above features and advantages and other features and advantages of the present invention are readily apparent from the following detailed description of the invention when taken in connection with the accompanying drawings.

BRIEF DESCRIPTION OF THE DRAWINGS

Other objects, features, advantages and details appear, by way of example only, in the following detailed description of embodiments, the detailed description referring to the drawings in which.

DESCRIPTION OF THE EMBODIMENTS

Various embodiments are directed to a charging system having an electrical plug or adapter with variable grounding. The electrical plug has a grounding design that satisfies the grounding requirements used for type E, F, L, J, and K style plugs. In other words, the electrical plug is configured to meet the needs of a plurality of grounding mechanisms currently in use in Continental Europe through a single plug design. This single plug design reduces the number of parts and the need for any AC plug adapters in charging systems.

Generally speaking, type E and F style plugs, which were hybridized into the CEE 7/7 plug, are often used in most of Western Europe and many countries in Eastern Europe. The type L plug, type J plug and type K plug are commonly used in Italy, Switzerland, and Denmark respectively.

Figure 1:
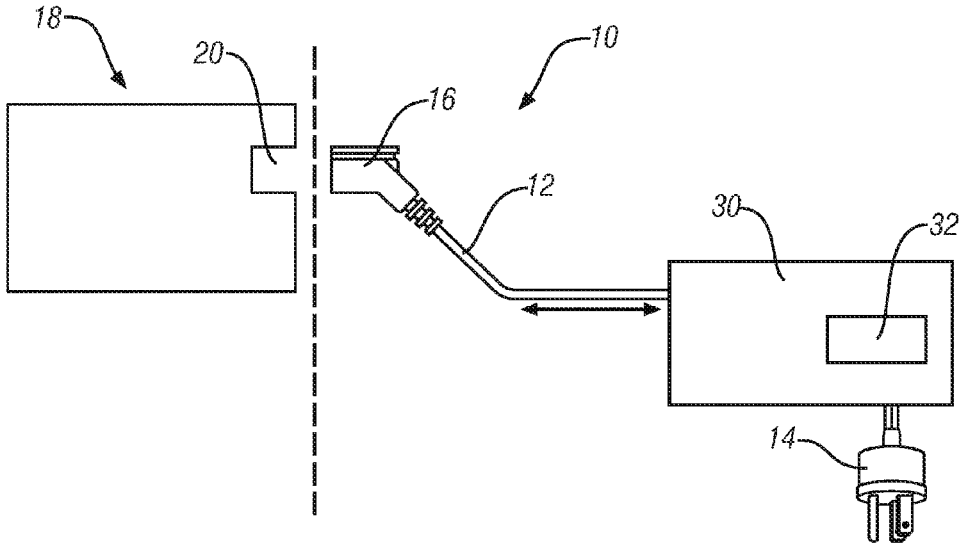
FIG. 1 illustrates a schematic of a vehicular charging system in accordance with one embodiment.

Referring now to the drawings, FIG. 1 illustrates a charging system 10 in accordance with one embodiment of the present invention. The charging system 10 can be directed to or be part of any type of system or portable device. However, for ease of discussion, the charging system 10 will be discussed in the context of a vehicle. In various embodiments, the charging system 10 is a vehicular charging system that includes a vehicle charging cord 12 comprising an electrical vehicle plug or electrical plug 14 with variable grounding and a socket end 16 each disposed at opposite ends of the cord 12. The electrical plug 14 plugs into a grounded wall receptacle (not shown) of one of various types (type E, F, L, J and K style receptacle) for charging a vehicle, which is generally indicated as vehicle 18. For example, the electrical plug 14 can plug into a standard 120V AC/15 or 20 amperes receptacle. The socket end 16 plugs into a charge receptacle 20 of the vehicle 18 to deliver current to a vehicle charging system (not shown). The socket end 16 of the charging cord 12 can have varying configurations depending on the configuration of the charge receptacle on the vehicle 18. Conductive wires/elements (not shown) insulated by the charging cord 12 run between the electrical plug 14 and the socket end 16 to enable proper charge delivery to the vehicle 18. In particular, conductive elements/wires run between the electrical plug 14 and the socket end 16 so that current transmission is established between the current producing mechanism (i.e., grounded wall receptacle) and the vehicle 18 and so that proper ground connection is established using the various grounding mechanisms, which will described in more detail below. The vehicle 18 described herein can be any type of electric vehicle or hybrid electric vehicle known or later developed.

In accordance with various embodiments, the vehicle charging cord 12 includes a charge station assembly 30 that serves as a connection verification system. More specifically, the charge assembly 30 operably determines when the electrical plug 14 is plugged into a wall receptacle with proper ground connection and/or when the socket end 16 of the charging cord 12 is fully inserted into the charge receptacle 20 in accordance with one embodiment. The charge assembly 30 generally comprises electrical vehicle supply equipment (EVSE), a controller 32 and other verification equipment (not shown) used for detecting and verifying proper ground connection. In operation, the controller 32 senses proper ground connection through one or more the various grounding mechanisms of the electrical plug 14 and indicates to the vehicle 18 that charge is ready to be delivered when proper ground connection is sensed. For example, the controller 32 supplies a signal (e.g., DC signal or oscillating signal) to a control pilot (not shown) of the vehicle 18 to indicate to the vehicle 18 that charge is ready to be delivered. This signal enables proper measures (i.e., grounding) to be taken at the vehicle side during charging. The controller 32 waits for the vehicle 18 to command the delivery of charge. This feature ensures that there is proper connection to the vehicle 18 and/or the wall receptacle so that the vehicle 18 can be charged reliably. In other words, this feature increases the reliability of the vehicle plug as the system will not allow high current to pass through unless the ground connection from one of the various grounding mechanisms is verified, thereby assuring correct use of the electrical plug. Variations of this feature and other reliability features can be performed at the controller and/or vehicle side and should not be limited to the examples described herein. The term "controller" as used herein refers to an application specific integrated circuit (ASIC), and electronic circuit, a processor (shared, dedicated, or group) and memory that executes one or more software or firmware programs/algorithms, a combinational logic circuit, and/or other suitable components that provide the described functionality.

FIGS. 2-5 are simplified schematics illustrating the basic elements of the electrical plug 14 having variable grounding in accordance with one embodiment of the present invention. The electrical plug 14 generally comprises a plug body 40 and a collar 42 configured to move or be adjusted along portions of the plug body 40 to selectively expose a face portion 44 of the electrical plug 14 such that the face portion 44 extends from a top surface 46 of the collar 42. A first electrical prong 48A and second electrical prong 48B extend from the plug body 14, and more specifically extend from the face portion 44 of the vehicle plug as shown.

Figure 2:
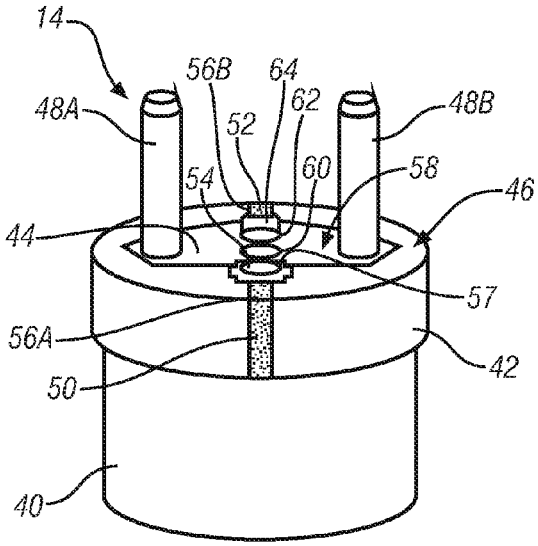
FIG. 2 illustrates a schematic of a vehicle plug of the vehicular charging system adjusted to fit a type CE 7/7 receptacle in accordance with one embodiment.

In one non-limiting embodiment, the vehicle plug, and more particularly the plug body 40 and the collar 42 of the vehicle plug has a rectangular cross-sectional shape as shown in FIG. 2. It is also contemplated that the electrical plug 14 may have a cross-sectional shape other than rectangular, such as, for example round, square, oval, or another appropriate shape depending on the application. The plug body 40 and the collar 42 can each be constructed or formed of molded rubber, plastic or other non-conductive material.

In one non-limiting embodiment, the face portion 44 of the electrical plug 14 has a hexagonal shape and fits into round and/or hexagonal sockets. The face portion 44 can also be constructed or formed would be better of molded rubber, plastic or other non-conductive material.

The electrical prongs 48A, 48B allow for current transmission between electrical connectors or wall socket type receptacles and the vehicle 18. In accordance with one embodiment, the electrical prongs 48A, 48B are fixed with respect to the face portion 44 and at no time can be adjusted. In other words, the prongs 48A, 48B are stationary. As such, live lines are not compromised through adjustment of the electrical plug 14 providing a more reliable electrical plug 14. The electrical prongs 48A, 48B may be made up of one or more metals, metal alloys or a combination thereof. For example, the electrical prongs 48A, 48B may be made of steel or brass, and may be plated with zinc, tin or nickel or other conductive materials or combinations thereof.

The collar 42 selectively adjusts to a first and second position along the plug body 40 depending on the desired grounding configuration or the desired grounding mechanism that is compatible with a specific receptacle in use. In accordance with one embodiment, the collar 42 exposes a first grounding contact 50 and a second grounding contact 52 at a first periphery edge portion 56A and a second periphery edge portion 56B of the collar 42 respectively. A third grounding contact 54 is accessed via a first opening 57 proximate to the grounding contact 50 as shown in FIG. 2. The grounding contacts 50, 52, and 54 are grounding mechanisms used for providing proper ground connection to the earth. The grounding contacts 50, 52 serve as face plates that replicate the grounding mechanism for a type F style receptacle while grounding contact 54 serves as a female receptacle in the plug that replicates the grounding mechanism for a type E style receptacle. In this configuration, the collar 42 is in the first position or in a non-adjusted position where the top surface 46 of the collar 42 is generally flush with an upper surface 58 of the face portion 44 as shown in FIG. 2. This configuration satisfies the needs of type F (grounding contacts 50, 52) and type E (grounding contact 54) style receptacles. Generally speaking, the face of the receptacle for receiving this vehicle plug configuration is usually recessed making the receptacle compatible with this vehicle plug configuration. This configuration is the standard configuration of the electrical plug 14.

Figure 3:
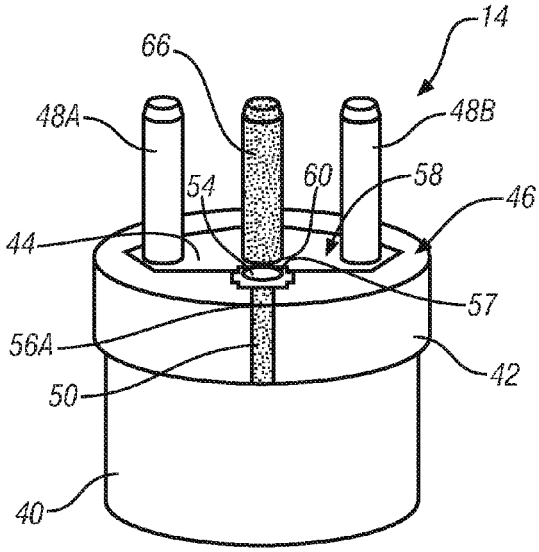
FIG. 3 illustrates a schematic of the vehicle plug of the vehicular charging system adjusted to fit a type L receptacle in accordance with one embodiment.

In accordance with one embodiment, the electrical plug 14 further includes a second opening 60, a third opening 62, and a fourth opening 64, that enable the electrical plug 14 to be adjusted for compatibility with type L, J, and K style receptacles, respectively. More specifically, the electrical plug 14 is configured to adjust to fit a type L style receptacle by exposing a first ground pin 66 via opening 60, which is positioned in the center and in line with electrical prongs 48A, 48B as shown in FIG. 3. Openings 60, 62, and 64 provide additional grounding mechanisms for providing ground to earth. In this configuration, the collar 42 is in the first position. The ground pin 66 is a separate component configured to be inserted and locked into opening 60 according to one embodiment. In an alternative embodiment, the ground pin 66 is disposed within the plug body 40 and is configured to move and extend from the opening 60. Once the ground pin 66 is inserted into opening 60, the ground pin is locked (automatically or manually) into place for proper grounding connection. The ground pin 66 can be exposed via opening 60 by performing mechanical movement of a button (not shown) or locking slide adjustment (i.e., flashlight type sliding button) according to one embodiment. Of course, other conventional or later developed methods of exposing ground pin 66 via opening 60 can be used according to other embodiments. In this configuration, the face of the receptacle for receiving this vehicle plug configuration is usually flat making the receptacle compatible with this vehicle plug configuration.

Figure 4:
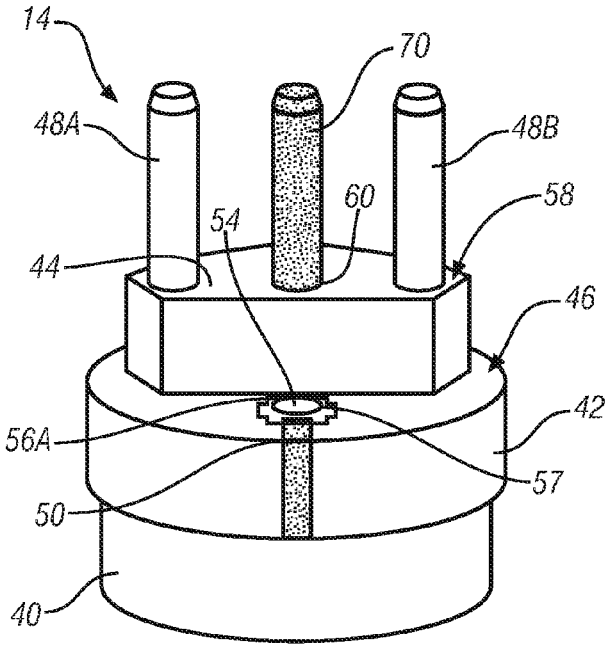
FIG. 4 illustrates a schematic of the vehicle plug of the vehicular charging system adjusted to fit a type J receptacle in accordance with one embodiment.

In accordance with another embodiment, FIG. 4, the electrical plug 14 is adjusted to fit a type J receptacle by adjusting the collar 42 to the second position and exposing a second ground pin 70 via opening 62, which is positioned in the center and offset with electrical prongs 48A, 48B. In this configuration, the collar 42 is positioned in the second position or in an adjusted position where the top surface 46 of the collar 42 is no longer flush with the upper surface 58 of the face portion 44. The collar 42 is adjusted to the second position by moving the collar 42 along plug body 40 and away from the upper surface 58 of the face portion 44. In other words, the collar 42 is retracted, exposing the face portion 44 necessary to fit into a corresponding receptacle/socket with a recessed face. The collar 42 automatically locks or is manually locked into place once the collar is adjusted to its second position. The collar 42 can be locked in place by one or more types of locking mechanism (e.g., twist lock). The ground pin 70 is separate component configured to be inserted and locked into opening 62 according to one embodiment. In an alternative embodiment, the ground pin 70 is disposed within the plug body 40 and is configured to move and extend from opening 62. Once the ground pin 70 is inserted into opening 62, the ground pin 70 is locked (automatically or manually) into place for proper grounding connection. The ground pin 70 can be exposed via opening 62 using the same techniques as described relative to the type L vehicle plug configuration. It is contemplated that a ground pin is used to serve as both ground pin 66 and ground pin 70.

Figure 5:
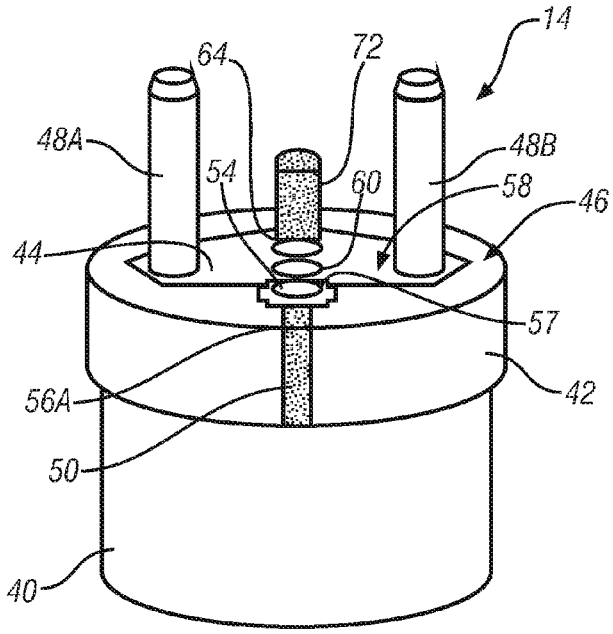
FIG. 5 illustrates a schematic of the vehicle plug of the vehicular charging system adjusted to fit a type K receptacle in accordance with one embodiment.

In accordance with another embodiment, FIG. 5, the electrical plug 14 is adjusted to fit a type K receptacle by exposing a third ground pin 72 via opening 64, which is positioned in the center and offset with electrical prongs 48A, 48B. The opening 64 can be formed through portions of the body 40 or portions of the face portion 44 depending on the application. In this configuration, ground pin 72 has a half-circle shape and the opening 64 also has a corresponding shape (half-circle). The ground pin 72 is shorter in height than electrical prongs 48A, 48B according to one embodiment. In this configuration, the collar 42 is in the first position. The ground pin 72 is a separate component configured to be inserted and locked into the half-circle opening 64 according to one embodiment. In an alternative embodiment, the ground pin 72 is disposed within the plug body 40 and is configured to move and extend from the opening 64. Once the ground pin 72 is inserted into opening 64, the ground pin 72 is locked (automatically or manually) into place for proper grounding connection. The ground pin 72 can be exposed via opening 64 using the same techniques as described relative to the type L vehicle plug configuration. In this configuration, the receptacle face of the receptacle for receiving this vehicle plug configuration is recessed.

Various embodiments of the vehicle plug design as described above offers exceptional adaptability since it meets the requirements of all continental European plug conventions (e.g., type E, F, L, J and K plugs). This system does not require any additional hardware, as most adapter systems do, and offers a user the most simple system that bars any usage limitations. It allows for a single piece of equipment to be used and maintained.

The grounding mechanisms described above are in some form electrically connected to corresponding conductive wires/elements that run along the plug/adapter and to the socket end, thereby enabling the vehicle to be properly grounded.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed as the best mode contemplated for carrying out this invention, but that the invention will include all embodiments falling within the scope of the present application.

What is claimed is:

1. An electrical plug, comprising:

a plug body;

a collar configured to selectively adjust between a first and second position along the plug body to selectively expose a face portion of the electrical plug, a top surface of the collar is flush with an upper surface of the face portion when the collar is in the first position and the top surface of the collar is positioned away from the upper surface of the face portion when the collar is in the second position;

a first electrical prong and a second electrical prong extending from the face portion, the first and second electrical prongs configured to enable current transmission; and a plurality of grounding mechanisms compatible with a plurality of receptacles respectively, each of the plurality of grounding mechanisms configured to provide a connection to ground.

2. The electrical plug of claim 1, wherein the plurality of receptacles includes type E, F, L, J, and K style receptacles.

3. The electrical plug as of claim 1, wherein current transmission is established between one of the plurality of receptacles and a vehicle.

4. An electrical vehicle plug for charging a vehicle, comprising:

a plug body;

a collar configured to selectively adjust between a first and second position along the plug body to selectively expose a face portion of the electrical vehicle plug, a top surface of the collar is flush with an upper surface of the face portion when the collar is in the first position and the top surface of the collar is positioned away from the upper surface of the face portion when the collar is in the second position;

a first electrical prong and a second electrical prong extending from the face portion, the first and second electrical prongs configured to enable current transmission to and from the vehicle; and a plurality of grounding mechanisms compatible with a plurality of receptacles respectively, each of the plurality of grounding mechanisms provide a connection to ground.

5. The vehicle plug of claim 4, wherein the plurality of receptacles includes type E, F, L, J, and K style receptacles.

6. The vehicle plug as of claim 5, wherein the plurality of grounding mechanisms includes a first and a second grounding contact compatible with a type F style receptacle, the collar being in the first position when the first and second grounding contact provide the connection to ground.

7. The vehicle plug as of claim 6, wherein the first and second grounding contact are located at a first and second periphery edge portion of the collar respectively.

8. The vehicle plug as of claim 6, wherein the plurality of grounding mechanisms includes a third grounding contact via a first opening proximate an edge portion of the collar, the third grounding contact being compatible with a type E style receptacle.

9. The vehicle plug of claim 5, wherein the plurality of grounding mechanisms includes a fourth grounding contact via a second opening positioned in the center and in-line with the first and second electrical prongs.

10. The vehicle plug of claim 9, wherein a first ground pin selectively extends from the second opening to fit a type L style receptacle, the first ground pin selectively extends from the second opening by inserting the first ground pin through the second opening by mechanical movement or sliding of a button.

11. The vehicle plug of claim 5, wherein the plurality of grounding mechanisms include a fifth grounding contact via a third opening positioned in the center and offset with the first and second electrical prongs, wherein the collar is in the second position when the fifth ground contact is used for the ground connection.

12. The vehicle plug as of claim 11, wherein a second ground pin selectively extends from the third opening to fit a type J style receptacle, the second ground pin selectively extends from the third opening by inserting the second ground pin through the second opening by mechanical movement or sliding of a button.

13. The vehicle plug as of claim 5, wherein the plurality of grounding mechanisms include a sixth grounding contact via a fourth opening positioned in the center and offset with the first and second electrical prongs, wherein the collar is in the first position when the sixth grounding contact is used for ground connection.

14. The vehicle plug as of claim 13, wherein a third ground pin selectively extends from the fourth opening and fits a type K style receptacle, the third ground pin selectively extends from the fourth opening by inserting the third ground pin through the fourth opening by mechanical movement or sliding of a button.

15. The vehicle plug as of claim 4, wherein the first and second electrical prongs are nonadjustable and fixed to the face portion.

16. The vehicle plug as of claim 4, wherein the first and second electrical prongs receive and deliver current from at least one of the plurality of receptacles to the vehicle when proper grounding connection is verified by a controller.

17. A vehicle charging cord for charging a vehicle, comprising:

a vehicle plug having:

a plug body;

a collar configured to selectively adjust between a first and second position along the plug body to selectively expose a face portion of the vehicle plug, a top surface of the collar is flush with an upper surface of the face portion when the collar is in the first position and the top surface of the collar is positioned away from the upper surface of the face portion when the collar is in the second position;

a first electrical prong and a second electrical prong extending from the face portion, the first and second electrical prong configured to transmit current to and from the vehicle;

a plurality of grounding mechanisms compatible with a plurality of receptacles respectively, each of the plurality of grounding mechanisms provide a connection to ground; and a controller configured to verify connection to ground and enable the first and second electrical prongs to receive and deliver current from at least one of the plurality of receptacles.

18. The vehicle charging cord of claim 17, wherein the plurality of receptacles includes type E, F, L, J, and K style receptacles.

19. The vehicle charging cord of claim 17, wherein the first and second electrical prongs are nonadjustable and fixed to the collar.

* * * * *